US005356015A

United States Patent [19]

Notebaart et al.

[11] Patent Number: 5,356,015

[45] Date of Patent: Oct. 18, 1994

[54] MAGNETIC SEPARATION PROCESS

[75] Inventors: Cornelis W. Notebaart; Frank P. Van Der Meer, both of Arnhem, Netherlands

[73] Assignee: Shell Research Limited, London, United Kingdom

[21] Appl. No.: 887,499

[22] Filed: May 26, 1992

[30] Foreign Application Priority Data

May 24, 1991 [GB] United Kingdom ..... 9111228

[51] Int. Cl.[5] ..... B03C 1/00

[52] U.S. Cl. ..... 209/214; 209/232

[58] Field of Search ..... 209/214, 221, 223.1, 209/224, 231, 232; 210/223, 695

[56] References Cited

U.S. PATENT DOCUMENTS

| | | | |
|---|---|---|---|
| 3,737,032 | 6/1973 | Burkitt | 209/232 X |
| 3,984,309 | 10/1976 | Allen et al. | 209/232 X |
| 4,187,170 | 2/1980 | Westcott et al. | 209/214 X |
| 4,352,730 | 10/1982 | Dijkhuis | 209/232 X |
| 4,539,040 | 9/1985 | Mawardi | 209/232 X |
| 4,594,149 | 6/1986 | Andres et al. | 209/232 X |
| 4,819,808 | 4/1989 | Andres et al. | 209/232 X |
| 4,902,428 | 2/1990 | Cohen | 210/695 |
| 5,004,539 | 4/1991 | Colwell, Jr. | 209/232 X |
| 5,137,629 | 8/1992 | Dauchez | 209/232 X |

FOREIGN PATENT DOCUMENTS 3610303 2/1987 Fed. Rep. of Germany ..... 209/232

*Primary Examiner*—D. Glenn Dayoan
*Assistant Examiner*—Tuan N. Nguyen
*Attorney, Agent, or Firm*—Jones, Tullar & Cooper

[57] ABSTRACT

In a process for separating relatively magnetic mineral particles $P_m$ having magnetic susceptibilities $\chi_m$, with $\chi_m>0$ from relatively non-magnetic particles $P_n$, having magnetic susceptibilities $\chi_n$, with $\chi_m>\chi_n$, all the particles are suspended in a liquid stream, which is supplied to a separating container. The container is provided with an inlet and an outlet and forms a passageway for the stream therebetween. Furthermore an arrangement of magnetizable matrix elements provided in the passageway is magnetized. The supplying and magnetizing are conditioned in such a way, that depositions of particles are obtained predominantly upon the downstream side of the elements. From all the particles magnetic particles $P_m$ are captured to an effective amount upon the downstream side, thereby resulting in a high grade deposition.

14 Claims, 3 Drawing Sheets

MAGNETIC SEPARATION PROCESS

BACKGROUND OF THE INVENTION

This invention relates to a process for separating relatively magnetic mineral particles $P_m$ having magnetic susceptibility $\chi_m$, with $\chi_m>0$, from relatively non-magnetic particles $P_n$ having magnetic susceptibilities $\chi_n$, with $\chi_m>\chi_n$, all the particles being suspended in a liquid stream.

Such a process is well known in the field of high gradient magnetic separation (HGMS) techniques, see for example the textbook by J. Svoboda, "Magnetic Methods for the Treatment of Minerals", Elsevier, 1987. Various types of separator devices are described therein. In detail they can be divided into two main classes based on their mode of operation, i.e. semi-continuous and continuous separators.

In the first type the separating container is called a canister and is typically cylindrical in shape. This canister which contains the matrix elements is usually placed in a solenoid which generates the magnetic field. The matrix elements distort this magnetic field to produce a gradient and hence a net magnetic force on the mineral particles (proportional to the product of magnetic field strength and field gradient). Pulp with the mineral mixture to be separated is fed for a given time to this canister. The magnetic mineral particles are deposited on the matrix elements. At the end of this period the feed is shut off and the canister is rinsed to displace residual lesser magnetic material from the canister. The field is then switched off and the magnetics are flushed off the matrix elements and a new cycle of feeding-rinsing-flushing can start. It is important to note that in this type of separator the canister is usually flooded, i.e. there is on no occasion an air-pulp interface. A moving interface could be problematic by unwantingly stripping off the magnetics from the matrix elements. Semi-continuous canister-type separators are widely used for purification of kaolinire for the paper industry (removal of iron oxide contaminants). The matrix in this case is stainless steel wool.

In the second type of separating device the separating containers with matrix elements are typically compartments in a horizontal carousel which rotate through the magnetic field. There are separators which do allow an interface between the pulp and the matrix elements an example being the widely used Jones separator which has grooved plates as the matrix elements and uses a conventional yoked electromagnet to generate the field. There is also a separator made by Sala in which the compartments are flooded requiring a sealing arrangement between the carousel and the stationary part which includes a solenoid magnet. The Sala separator uses either expanded metal sheets (usually in mineral processing applications other than clay purification) or stainless steel wool as the matrix.

The present invention relates primarily to the flooded separators.

There are various possible orientations of matrix elements (assumed to be elongated bodies), feed flow direction and magnetic field direction. Primarily the so-called longitudinal orientation is concerned in which the field and flow direction are mutually parallel and both perpendicular to the matrix element. In current practice in which this orientation is used conditions are such that the magnetic deposit is formed on the upstream side of the matrix element. The problem with this is that relatively non-magnetic or lesser magnetic unwanted mineral particles are mechanically entrained from the feed flow which is impinging upon the deposit of previously captured material and causes contamination of the magnetics.

However, under certain hydrodynamic conditions in the longitudinal orientation a deposit can be formed on the downstream side of the matrix elements as indicated in I.E.E.E. Transactions on Magnetics, Vol. MAG-15, Nov. 6, 1979, page 1538, "HGMS at moderate Reynolds numbers", by J. H. P. Watson, and standing vortices then form in this region as is well-known from classical hydrodynamics of flow around a cylindrical body. This phenomenon has been observed in experiments on pure phases.

If mineral separation in industrial application is concerned, such separation is usually characterized in terms of recovery of ore minerals and more commonly of contained valuable elements and grade of such minerals or elements. The recovery of a particular element is the quantity of such element reporting to the desired separation product or concentrate, expressed as a percentage of that contained in the feed. The product grade is the content of a particular mineral or element in that product usually expressed as a percentage of the total mass of the mineral or element contained in that product. In the following expressis verbis grade percentages calculated and explained are defined as mineral weight percentages.

Recovery and grade both determine the effectiveness of a separation. Their separate consideration is usually meaningless. The selectivity of a process can be expressed as the product grade of a certain element obtained at a particular recovery. The statement that one separation method is more selective than another, i.e. in the former higher grades are obtained at a specified recovery may only be valid for a particular range of recoveries. The relationship between grade and recovery for a given separation process can be evaluated experimentally and is usually such that higher recoveries correspond to lower product grades and vice versa.

SUMMARY OF THE INVENTION

Thus it is an object of the present invention to arrive at a more selective separation in HGMS, i.e. at higher magnetics grades for a given recovery as compared to the prior art.

Therefore in accordance with the present invention the above indicated process is further characterized in that, the supplying and magnetizing are conditioned in such a way, that depositions of particles are obtained predominantly upon the downstream side of the elements, from all the particles magnetic particles $P_m$ being captured to an effective amount upon the downstream side, thereby resulting in a high grade deposition.

Advantageously mechanical entrainment of unwanted relatively non-magnetic minerals is reduced to a minimum resulting in high product grades.

By using the process of the present invention advantageous recoveries of at least 50% and grades of at least 60% mineral weight are obtained.

In advantageous embodiments of the process, matrices of steel wool, expanded metal, round wires, or wedge wire screens are applied as magnetizable elements in a canister or in a carousel compartment being examples of separating containers.

From detailed investigations the following separation and capture model could be derived for the process as applied, in particular for matrix wires with cylindrical cross-section in accordance with the present invention.

The process for effectively separating magnetic particles in accordance with the present invention can be divided into three distinct separation stages:

1) a first one comprising the region upstream of a matrix element in which magnetics deposition usually occurs and which region now only serves as a magnetic particles focusing area;
2) a second one comprising the region downstream of such a matrix element in which capture and deposition of magnetics occurs according to the present invention; and
3) a third one comprising the boundary layer adjacent to the matrix element between the above two regions.

In the first region the possibility of mechanical entrainment has been essentially removed as there is no or little deposition of magnetics in this area. This region is merely a focusing area for magnetics from an area with an effective cross-section larger than that of the matrix element. The magnetic mineral particles migrate to the matrix element, but are not retained because of the hydrodynamic conditions as applied. They are transported through the above boundary layer region into the second region where they are magnetically captured out of the vortex flow patterns which are formed there.

Limited separation may also occur in the boundary layer. It is known to those skilled in the art that coarse particles of a mineral with a lower susceptibility than that of the ore mineral can be magnetically captured with the same probability as that for smaller particles of the ore mineral which has a higher selectivity. However, it has been observed that particles may not be transported from the boundary layer to the downstream side of the matrix element if the diameter exceeds a certain fraction of the boundary layer thickness. Thus under particular conditions such coarse relatively weaker magnetic particles might be prevented from entering the vortices from which they could be magnetically captured.

Relatively non-magnetic or gangue mineral particles which directly impinge on the matrix element could also be transported through the boundary layer into the second region. The nature of the vortex flow patterns or vortices is such that much of the return flow in these vortices is more or less parallel to the magnetics deposit and therefore mechanical entrainment is minimized. Thus, the fact that there is no direct impingement of the main flow onto the deposit only a relatively small quantity of gangue mineral particles is transported to the depositional area. Flow directions in this region result in a strongly reduced level of contamination of the deposit upon the downstream side.

BRIEF DESCRIPTION OF THE DRAWINGS

The invention will now be described by way of example in more detail with reference to the accompanying drawings.

DETAILED DESCRIPTION

Figure 1:
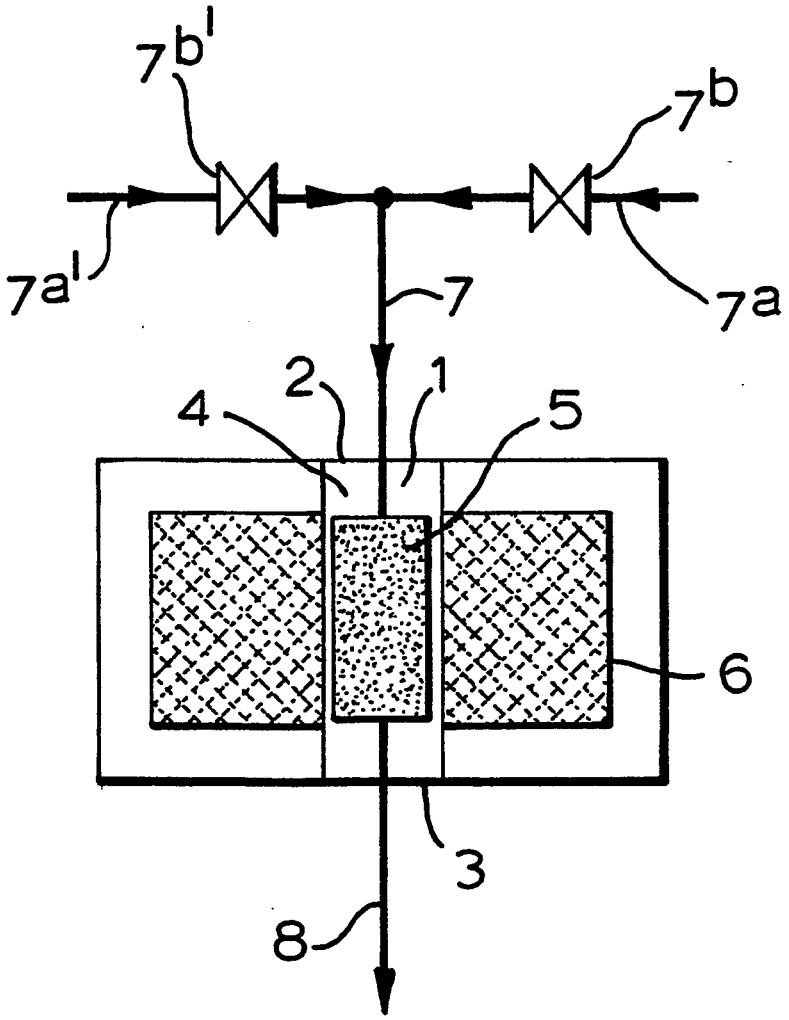
In FIG. 1 schematically illustrates a canister-type magnetic separator device as known from the prior art.

Referring to FIG. 1 a magnetic separator device comprises a canister 1, having an inlet 2 and an outlet 3, thereby defining a passageway 4 therebetween. In the passageway 4, an arrangement of magnetizable elements 5 is arranged. The canister 1 is surrounded by a magnet 6, for example a coil forming an electromagnet by means of which the elements 5 are magnetized. Through a supply conduit 7 a liquid stream containing particles which are suspended therein and which consist of relatively magnetic particles $P_m$ having magnetic susceptibilities $\chi_m$, with $\chi_m > 0$, and relatively non-magnetic gangue particles $P_n$, having magnetic susceptibilities $\chi_n$, with $\chi_m > \chi_n$, thus forming a slurry, is supplied. Furthermore the inlet of supply conduit 7 is branched. Through one branch **7*a* supply of the particles containing stream is controlled by means of a supply valve 7*b*. When the magnet 6 is energized the slurry containing stream passes the canister. Depending on magnetic and hydrodynamic conditions to be discussed hereafter the relatively magnetic particles $P_m$ can be captured the elements 5 whereas the other particles will be mainly dragged through the canister to an outlet conduit 8. After the matrix has been loaded subsequently supply valve 7*b* is closed. Then through a rinse conduit 7*a'* a rinsing liquid stream controllable by means of a rinse valve 7*b'* is allowed to rinse the matrix 5 from residual gangue particles which have not been deposited on the matrix elements but occur in interstitial spacings between the elements. The magnet 6** is switched off and the magnetic deposit is flushed off the matrix either in a reverse direction or in a cocurrent direction relative to the feed direction. Then the magnetic particles are collected separately from the non-magnetic material, the latter being discharged during the feed cycle and during rinsing. Thereafter a new cycle can be started. In further detail with concern to the slurry consisting of particles $P_m$ and $P_n$ it will be clear that both $P_m$ and $P_n$ can comprise different kinds $P_{m1}$, $P_{m2}$, . . . , and $P_{n1}$, $P_{n2}$, . . . with respective susceptibilities $\chi_{m1}$, $\chi_{m2}$, . . . , and $\chi_{n1}$, $\chi_{n2}$, . . . Furthermore, it is noted that in the usual way the susceptibilities used and expressed in SI-units are volume magnetic susceptibilities.

EXAMPLE

In the following example the device of FIG. 1 is employed for carrying out the process of the present invention on a mixture of wolframite ($(FeMn)WO_4$) and arsenopyrite (FeAsS) in a mass ratio of 6:4 and having magnetic susceptibilities of $3490*10^{-6}$ (SI) and $25*10^{-6}$ (SI) respectively. Both minerals were ground to particles having grain sizes up to 100 $\mu$m.

The magnetic field applied had magnetic induction values up to 5 Tesla, and thus field strength values up to $4*10^3$kA/m, whereas the average flow velocity of the liquid stream through a cylindrical canister having a diameter of 37 mm was varied between 50 mm/s and 275 mm/s.

The matrix elements existed of fine expanded steel, having mesh openings of 1*2 mm with the elements mainly perpendicular to the downward flow of the liquid stream over a height of 15 cm, whereas the effective wire diameter being the projected cross-section was about 0.4 mm.

In Table I given below grade and recovery values for the respective experiments are given.

TABLE I

| Magnetic Induction Tesla | Flow velocity mm/s | Mass distribution % (m/m) | | Grade % (m/m) | | | | | | Recovery % | | | |
|---|---|---|---|---|---|---|---|---|---|---|---|---|---|
| | | | | Mags | | Nonmags | | Calc'd feed | | Mags | | Nonmags | |
| | | Mags | Nonmags | $WO_3$ | As | $WO_3$ | As | $WO_3$ | As | $WO_3$ | As | $WO_3$ | As |
| 0.91 | 50 | 66.6 | 33.4 | 51.9 | 9.0 | 25.9 | 18.5 | 43.2 | 12.2 | 80.0 | 49.2 | 20.0 | 50.8 |
| | 100 | 43.2 | 56.8 | 64.4 | 2.8 | 28.7 | 17.5 | 44.1 | 11.1 | 63.0 | 10.9 | 37.0 | 89.1 |
| | 245 | 25.2 | 74.8 | 70.0 | 2.3 | 39.0 | 14.6 | 46.8 | 11.5 | 37.6 | 5.0 | 62.4 | 95.0 |
| | 275 | 27.5 | 72.5 | 69.7 | 0.9 | 34.5 | 15.2 | 44.1 | 11.3 | 43.4 | 2.3 | 56.6 | 97.7 |
| 2.1 | 50 | 78.1 | 21.9 | 50.4 | 11.1 | 11.8 | 28.0 | 41.9 | 14.8 | 93.8 | 58.5 | 6.2 | 41.5 |
| | 119 | 60.4 | 39.6 | 63.2 | 4.1 | 12.9 | 26.5 | 43.3 | 12.9 | 88.2 | 19.0 | 11.8 | 81.0 |
| | 275 | 49.5 | 50.5 | 70.7 | 0.9 | 16.9 | 24.3 | 43.5 | 12.7 | 80.4 | 3.4 | 19.6 | 96.6 |
| 3.5 | 50 | 88.7 | 11.3 | 43.0 | 14.6 | 11.7 | 26.2 | 39.5 | 15.9 | 96.6 | 81.3 | 3.4 | 18.7 |
| | 125 | 62.8 | 37.2 | 62.4 | 4.9 | 15.3 | 24.7 | 44.9 | 12.3 | 87.3 | 25.1 | 12.7 | 74.9 |
| | 245 | 53.3 | 46.7 | 69.5 | 1.7 | 18.9 | 23.9 | 45.9 | 12.0 | 80.8 | 7.6 | 19.2 | 92.4 |
| 5.0 | 50 | 92.9 | 7.1 | 43.4 | 14.4 | 20.7 | 16.1 | 41.8 | 14.5 | 96.5 | 92.1 | 3.5 | 7.9 |
| | 125 | 67.5 | 32.5 | 57.3 | 7.3 | 12.5 | 27.7 | 42.8 | 13.9 | 90.5 | 35.4 | 9.5 | 64.6 |
| | 245 | 59.1 | 40.9 | 66.4 | 3.2 | 12.2 | 27.8 | 44.3 | 13.3 | 88.7 | 14.3 | 11.3 | 85.7 |

Separation performances are expressed in grades and recoveries of $WO_3$ and As, relating to the minerals composition ratios, $FeMnWO_4$: 70–74% $WO_3$, and arsenopyrite, FeAsS: 33–40% m/m As respectively. These are calculated for both separation products: the magnetics, "mags" products, with predominantly the more magnetic component, i.e. the wolframite, and the relatively non-magnetics, "non-mags" product, i.e. the arsenopyrite. The recovery values are calculated using the measured grade values and the mass distribution percentages to these two products.

From the table two main observations can be made.

The first one is that for a given velocity the higher the magnetic induction, the higher the recovery, both for $WO_3$ and for As. So, in another way it can be said that more magnetic mineral particles are captured when a stronger field is applied.

The second one is that for each set of measurements at the same field strength, the higher the flow velocity, the lower the As-grade, and consequently the higher the $WO_3$-grade. In other words the relative content of wolframite in the deposit is increased at higher flow velocities.

In detail one can take the separation at 0.91 T and 50 mm/s as a reference, the conditions being similar to those used in practice. At these conditions a recovery of 80% $WO_3$ is obtained at a magnetics grade of 51.9% m/m $WO_3$. As can be seen from Table I an increase in flow velocity increases the $WO_3$ grade but decreases the $WO_3$ recovery unacceptably down to 43% at the highest velocity. The recovery could be increased at this high velocity by increasing the field strength as noted previously. It is to be expected that this would also increase the arsenopyrite recovery. This is indeed the case but this reduction in grade is such that compared to the above reference still a beneficial effect results, i.e. at 2.1 T and 275 mm/s the recovery (80% $WO_3$) is close to that obtained in the reference, but the $WO_3$ grade is much higher, i.e. 70.7% m/m $WO_3$ as compared to 51.9% m/m $WO_3$. The selectivity is thus considerably increased by operation at high velocity and high field. At very high fields a further increase in wolframite recovery can be achieved, be it at a small increase in arsenopyrite grade.

Figure 2:
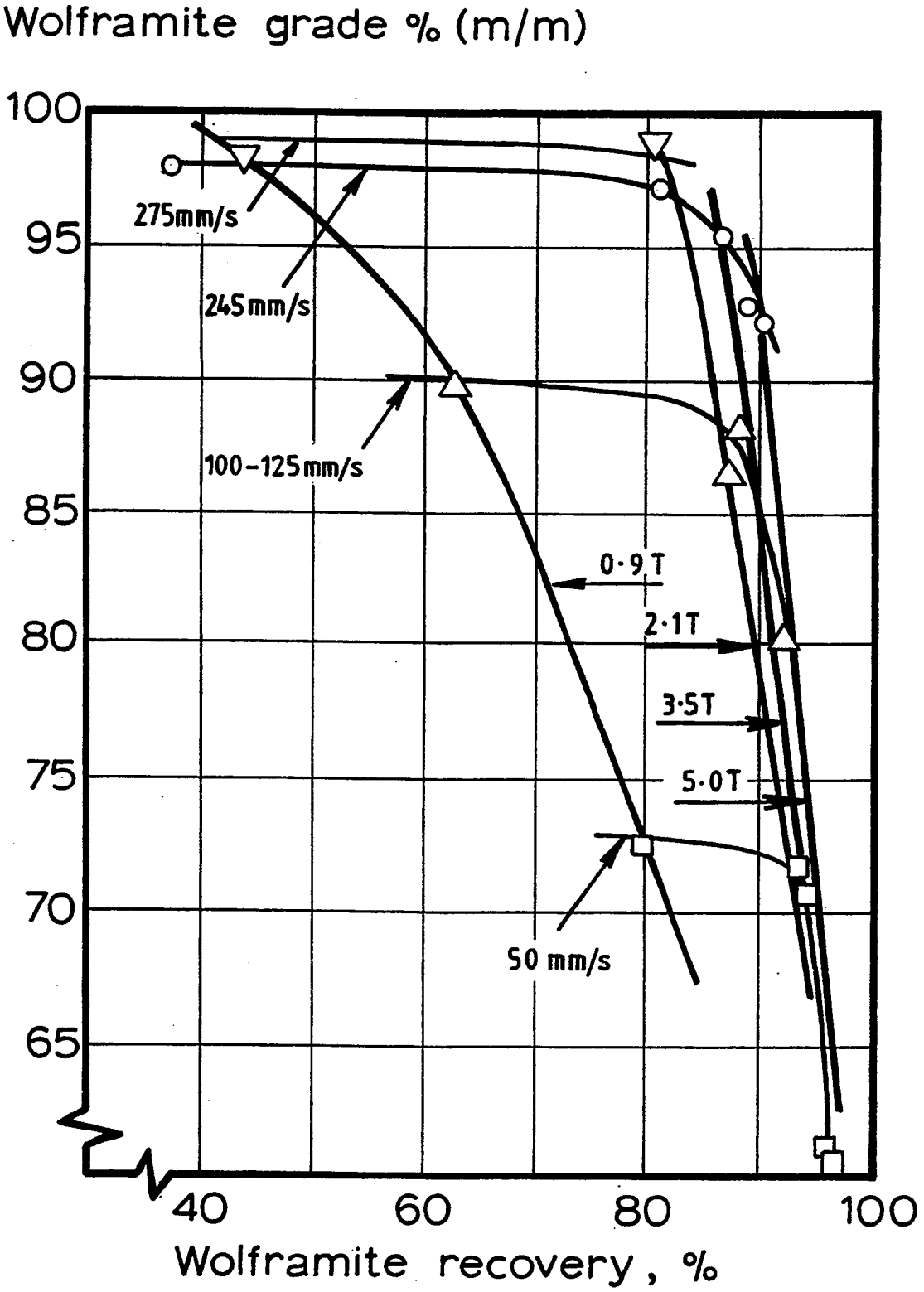
In FIG. 2 is a graph presenting results as obtained by the process in accordance with the present invention.

By plotting these results in a grade-recovery plot as shown in FIG. 2 it can be seen that different grade-recovery curves are generated for different velocities. In particular the above mentioned selectivity increase is shown clearly.

Further to the above, photographs of the deposit formation on single matrix elements did show that from about a velocity of 100 mm/s a significant build-up of material started to form on the downstream side, increasing in proportion at higher velocities. At those conditions vortex flow patterns could be observed.

For those skilled in the art it will be clear that all kinds of magnetic particles are concerned, for example paramagnetic, ferromagnetic, canted anti-ferromagnetic, or ferrimagnetic mineral particles. Examples of those mineral ore particles are wolframite, sphalerite, chalcopyrite, bornite, and rutile as paramagnetic particles, magnetite as a ferrimagnetic, hematite as a canted anti-ferromagnetic, and cassiterite behaving as a paramagnetic, being comprised of the diamagnetic tindioxide particles having ferrimagnetic magnetite particles included therebetween.

From experiments it has furthermore appeared that in a range up to 50% m/m solids in the liquid stream making up the slurry supplied to the separator device advantageous results are obtained, whereas the particles forming the solids have advantageous diameters up to 150 μm.

Further to the above explanations as to the example and the photographs it will be clear that the process in accordance with the present invention is based on the predominant downstream deposition or capture resulting from hydrodynamic conditions and magnetic field strengths suitably chosen. Those skilled in the art will understand that in no way the features may be considered separately.

As to the hydrodynamic conditions fluid flow is often related and typified by a Reynold's number. As generally known the definition of the parameter is determined by a.o. obstacle geometry, fluid viscosity and fluid density, and will consequently vary largely from one process to the other. Therefore no further restrictions and conditions can be given for the process in accordance with the invention rather than the vortex flow pattern conditions contributing highly to the high grade deposition upon the downstream side of the magnetizable elements. Thus, if suitable overall conditions are chosen, advantageous grades of at least 60% mineral weight and recoveries of at least 50% are obtained.

As will be clear from the above many kinds of magnetizable elements can be used. Although in the above example only expanded steel wirelike matrix elements are comprised in the passageway through the canister, also matrix element arrangements comprising round wires, expanded metal or wedge wire screens have appeared to give advantageous results. So, many matrix arrangements, if causing high magnetic field gradients, are applicable.

Figure 3:
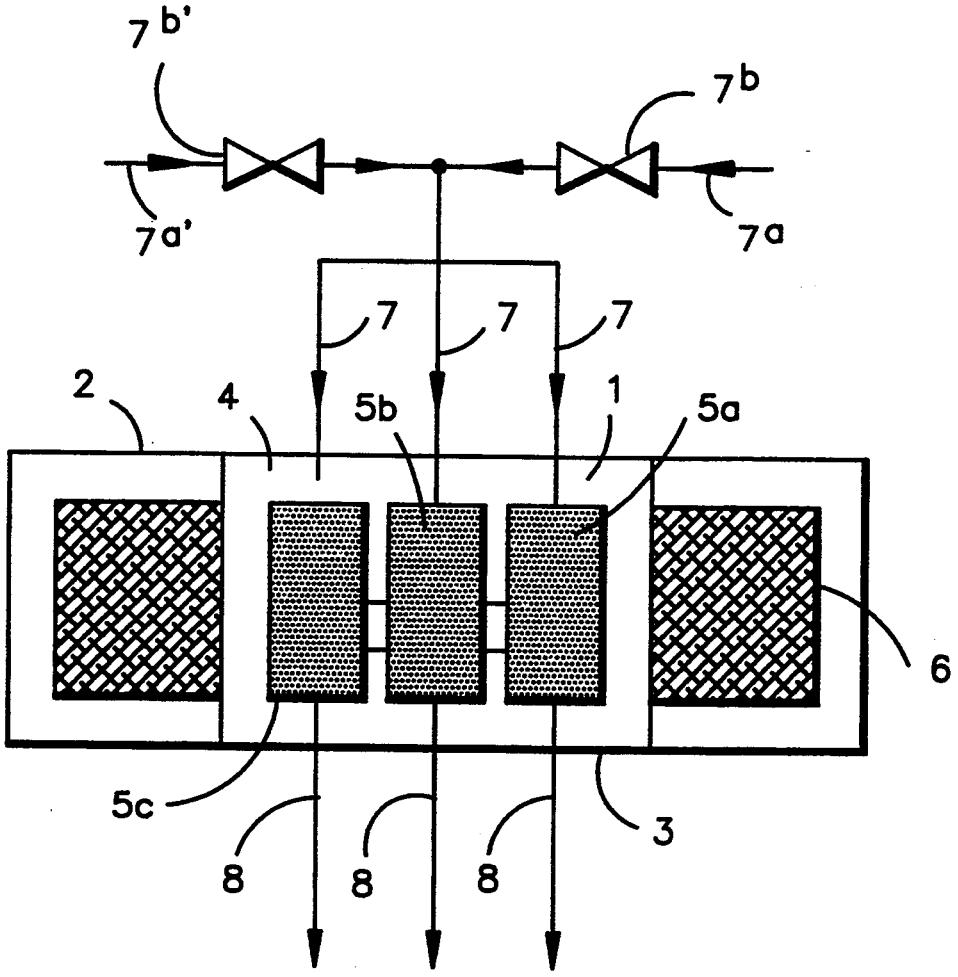
FIG. 3 schematically illustrates the carousel compartment according to a variant of the present invention.

Various modifications of the present invention will become apparent to those skilled in the art from the foregoing description and accompanying drawing. For example, as shown in FIG. 3, a plurality of elements 5*a*, 5*b*, 5*c* . . . 5*n* forming a carousel compartment is possible. Such modifications are intended to fall within the scope of the appended claims.

We claim:

1. A process for separating relatively magnetic mineral particles $P_m$ having magnetic susceptibilities $\chi_m$, with $\chi_m>0$, from relatively non-magnetic particles $P_n$, having magnetic susceptibilities $\chi_n$, with $\chi_m>\chi_n$, all said particles being suspended in a liquid stream, the process comprising the steps of:

providing a separating container having an inlet and an outlet and a passageway formed therebetween;

providing an arrangement of magnetizable matrix elements in the passageway;

magnetizing the arrangement of magnetizable matrix elements to a predetermined degree by means of a magnet located adjacent to the passageway; and supplying the liquid stream to the passageway at a predetermined velocity, wherein the supplying velocity and magnetizing degree are such that vortex flow patterns are created in said stream at the downstream side of the matrix elements, and that depositions of particles are obtained predominantly upon the downstream side of the matrix elements, and from all said particles magnetic particles $P_m$ being captured to an effective amount upon the downstream side, thereby resulting in a high grade deposition.

2. The process as claimed in claim 1, wherein the high grade deposition is obtained by combined deposition resulting from depositions of at least two kinds of mineral particles $P_{m1}$, $P_{m2}$, . . . having magnetic susceptibilities $\chi_{m1}$, $\chi_{m2}$.

3. The process as claimed in claim 1, wherein the relatively non-magnetic particles $P_n$, having magnetic susceptibilities $\chi_n$, comprise at least two kinds of particles $P_{n1}$, $P_{n2}$, . . . , having magnetic susceptibilities $\chi_{n1}$, $\chi_{n2}$.

4. The process as claimed in claim 1, 2 or 3 wherein said particles $P_m$ and $P_n$ and said liquid stream form a slurry, containing solids in the range of from 5 to 50% weight.

5. The process as claimed in claim 1 or 2, wherein said high grade is at least 60% mineral weight.

6. The process a claimed in claim 1 or 2, wherein said effective amount is at least a recovery of 50%.

7. The process as claimed in claim 1, 2 or 3, wherein said particles $P_m$ and $P_n$ have diameters $d<150$ $\mu$m.

8. The process as claimed in claim 1 or 2, wherein said particles $P_m$ are paramagnetic particles.

9. The process as claimed in claim 1, wherein said arrangement comprises matrix elements of steel wool.

10. The process as claimed in claim 1, wherein said arrangement comprises matrix elements of expanded metal.

11. The process as claimed in claim 1, wherein said arrangement comprises matrix elements of round wires.

12. The process as claimed in claim 1, wherein said arrangement is built up from wedge wire screens.

13. The process as claimed in claim 1, wherein said separating container is a canister.

14. The process as claimed in claim 1, wherein said separating container is a carousel compartment.

* * * * *